United States Patent [19]

Tanaka

[11] Patent Number: 4,495,227

[45] Date of Patent: Jan. 22, 1985

[54] FOAMABLE SILICONE-CONTAINING COMPOSITION FOR TREATMENT OF FABRIC MATERIALS

[75] Inventor: Masaki Tanaka, Gunma, Japan

[73] Assignee: Shin-Etsu Chemical Co., Ltd., Tokyo, Japan

[21] Appl. No.: 487,202

[22] Filed: Apr. 21, 1983

[30] Foreign Application Priority Data

Apr. 26, 1982 [JP] Japan ..... 57-69837

[51] Int. Cl.[3] ..... B05D 3/02; C08J 9/00; C08J 9/32; C08G 77/00

[52] U.S. Cl. ..... 427/373; 427/387; 427/389.9; 427/393.4; 521/76; 521/86; 521/110; 521/112; 521/154

[58] Field of Search ..... 427/245, 387, 389.9, 427/393.4, 373; 521/76, 86, 110, 112, 154

[56] References Cited

U.S. PATENT DOCUMENTS

| | | | |
|---|---|---|---|
| 3,677,981 | 7/1972 | Wada et al. | 521/154 X |
| 3,791,998 | 2/1974 | Bruns | 521/154 X |
| 4,026,842 | 5/1977 | Lee et al. | 521/154 |
| 4,094,685 | 6/1978 | Lester et al. | 521/76 |

*Primary Examiner*—Michael R. Lusignan
*Attorney, Agent, or Firm*—Toren, McGeady and Stanger

[57] ABSTRACT

The invention provides a novel silicone-containing curable composition capable of foaming by virtue of the blowing agent contained therein together with a curable liquid silicone composition. The composition is suitable for the water-repellent and waterproof treatment of fabric materials without decreasing the air and moisture permeability of the treated fabric material.

6 Claims, No Drawings

FOAMABLE SILICONE-CONTAINING COMPOSITION FOR TREATMENT OF FABRIC MATERIALS

BACKGROUND OF THE INVENTION

The present invention relates to a foamable silicone-containing composition suitable for the treatment of a fabric material or, in particular, woven cloth.

It is well known that woven cloths and other fabric materials can be imparted with waterproofness or water-repellency by the coating treatment with certain agents such as various kinds of synthetic resins for fabric treatment, e.g. ethyleneurea resins, methylolmelamine resins and the like, paraffins, urethane rubbers, acrylic rubbers and the like. Although such a method of waterproofing or water-repellent treatment is well established in the art and widely practiced, conventional methods of such a treatment have a problem that the finished fabric material has a very hard touch in addition to the insufficient effects of waterproofness or water repellency. Therefore, it has been eagerly desired to develop a waterproofing or water repellent agent capable of imparting a treated fabric material with softer touch exhibited even at low temperatures with an object to use the treated fabric material for clothing.

On the other hand, clothes made of a fabric material treated with a conventional fabric-treatment agent as mentioned above are defective also in respect of their poor air and moisture permeability so that wearers of such clothes as an outerwear in summer weather or for labor works or sports always feel very uncomfortable due to the stuffiness as a result of greatly suppressed dissipation of the sweat or body heat.

There is a disclosure of a method for the preparation of a waterproof cloth, for example, in Japanese Patent Publication No. 42-1794 according to which a woven cloth is coated with a solution containing a curable silicone rubber terminated at both molecular chain ends with silanolic hydroxy groups as the main ingredient followed by a heat treatment. Alternatively, Japanese Patent Publication No. 42-15597 teaches a method for the preparation of a waterproof cloth according to which a woven cloth is coated with a solution containing a curable silicone rubber and an acrylic or urethane rubber as the main ingredients followed by a heat treatment. These methods of treatment with a solution containing a silicone rubber are indeed effective in imparting the treated cloth with soft or slippery touch but the problem of the poor permeability of air and moisture remains unsolved.

SUMMARY OF THE INVENTION

Thus, an object of the present invention is to provide a novel composition suitable for the treatment of a fabric material with which the treated fabric material can be imparted with full waterproofness and water repellency while the air and moisture permeability thereof is greatly increased in comparison with the fabric materials treated with conventional waterproofing or water repellent compositions.

The composition of the present invention developed with the above mentioned object comprises a curable silicone composition with a liquid organopolysiloxane as the main ingredient thereof and is foamable by admixing 1 to 200 parts by weight of a foaming or blowing agent per 100 parts by weight of the curable silicone composition.

The above described foamable silicone-containing composition is advantageous when used in the treatment of a fabric material in several respects that (1) the moisture permeability of the woven cloth treated therewith is 5 to 10 times larger than the cloths treated with a conventional composition with the same degree of the waterproofness and water repellency as well as the pleasant touch with softness and slipperiness as is usually called silicone touch, (2) full and sufficient effects of the fabric treatment can be obtained without the necessity of any particular equipments over the conventionally used ones and in a treatment procedure which is about the same as in the conventional procedures and (3) the wearer of the clothes made of the cloths treated with the inventive composition feels very comfortable by virtue of the larger permeability of sweat and body heat in comparison with conventional waterproof or water repellent clothes due to the greatly improved air and moisture permeability as mentioned above.

DETAILED DESCRIPTION OF THE PREFERRED EMBODIMENTS

The curable silicone composition used in the inventive foamable silicone-containing composition comprises a liquid diorganopolysiloxane of substantially linear molecular structure having at least two functional groups bonded to the silicon atoms in a molecule as the base polysiloxane and a liquid organosilicon compound having, in a molecule, at least three functional groups capable of reacting with the functional groups in the base polysiloxane to form linkages with admixture of a suitable curing catalyst.

The functional groups in the base polysiloxane, i.e. the liquid diorganopolysiloxane of linear molecular structure, are exemplified by hydroxy group, alkenyl groups, e.g. vinyl and allyl groups, epoxy group, mercapto group and the like. The diorganopolysiloxane should have at least two of these functional groups in a molecule. On the other hand, the functional groups in the liquid organosilicon compound to be used in combination with this base polysiloxane are exemplified by hydrogen atoms directly bonded to the silicon atoms, vinyl group, allyl group, alkoxy groups, acyloxy groups, oxime groups, aminoxy groups, isopropenoxy group and the like. The liquid organosilicon compound should have at least three of these functional groups in a molecule.

It is of course that the functional groups in the base polysiloxane and the functional groups in the liquid organic silicon compound to be combined therewith should be reactive with each other to form crosslinks between these two components so that combination of them is limited. Following (1) to (3) are several typical examples of the possible combinations of these functional groups.

(1) A diorganopolysiloxane terminated at both molecular chain ends with silanolic hydroxy groups and represented by the general formula

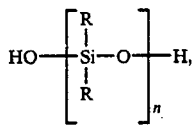

in which R is a hydrocarbon group or a halogen-substituted hydrocarbon group having 1 to 20 carbon atoms, at least 50% by moles of the groups denoted by R being preferably methyl groups, and n is a positive integer, is combined with an organohydrogenpolysiloxane having at least three hydrogen atoms directly bonded to the silicon atoms in a molecule together with a condensation catalyst.

(2) The diorganopolysiloxane terminated at both molecular chain ends with silanolic hydroxy groups as given in (1) above is combined with a liquid organosilicon compound, which may be an organosilane or an organopolysiloxane, having at least three hydrolyzable groups bonded to the silicon atom or atoms in a molecule together with a condensation catalyst.

(3) An organopolysiloxane having at least two vinyl groups bonded to the silicon atoms in a molecule is combined with an organohydrogenpolysiloxane having at least three hydrogen atoms directly bonded to the silicon atoms in a molecule together with a catalyst for the addition reaction of hydrosilation.

The condensation catalyst used in the above given combinations (1) and (2) is exemplified by tin compounds such as dibutyltin dilaurate, dioctyltin dilaurate, dioctyltin diacetate, tin octylate and the like, carboxylic acid salts of iron, zinc, lead and the like metals, platinum compound such as chloroplatinic acid and amine compounds according to the types of the condensation reaction and the catalyst for the addition reaction in the above given combination (3) may be platinum or a platinum compound such as platinum black, chloroplatinic acid and the like.

The organosilane compound as a class of the liquid organosilicon compounds in the above given combination (2) is represented by the general formula $R^1SiX_3$, in which $R^1$ is a hydrocarbon group such as methyl group, phenyl group and the like and X is a hydrolyzable group including alkoxy groups such as methoxy, ethoxy and propoxy groups, acyloxy groups such as acetoxy group, oxime groups, aminoxy groups, isopropenoxy group and the like.

In the next place, the foaming or blowing agents suitable for use in the present invention include those widely used in the plastics or synthetic rubber industries such as thermally decomposable organic blowing agents and the microcapsule type blowing agents which may be microcapsules encapsulating an organic liquid having a low boiling point with a synthetic resin film having resistance against solvents. Examples of the thermally decomposable organic blowing agents include several organic compounds decomposable by heating producing gaseous decomposition products such as azobisisobutyronitrile, dinitroso pentamethylene tetramine, azobisformamide and the like. The blowing agents of the microcapsule type include the microcapsules of a hydrocarbon or halogenated hydrocarbon solvent as well as ether and alcoholic solvents having a low boiling point such as isobutane, n-hexane, diethyl ether, methyl alcohol, methylene chloride, trichloroethane and the like encapsulated in a polyvinylidene chloride resin film and the microcapsules of water or alcohol encapsulated in a silicone resin.

The foamable silicone-containing composition of the present invention is obtained by blending from 1 to 200 parts by weight or, preferably, from 10 to 100 parts by weight of the above mentioned blowing agent with 100 parts by weight of the curable silicone composition mainly composed of the above described liquid diorganopolysiloxane. The blowing agent may be blended with the curable silicone composition either in advance to form a ready-mixed mixture or directly before application of the composition. It is optional that the inventive composition is diluted with an organic solvent to have a viscosity or consistency suitable for application to cloths. The inventive composition may contain other conventional additives such as an inorganic filler, coloring agent, e.g. pigment, and the like.

Treatment of a fabric material with the above described inventive composition is performed by coating the fabric material with the composition by knife coating, roller coating, dipping or the like known method followed by preliminary drying and then heat treatment so that the composition is cured with simultaneous foaming to give a coating film on the fabric material having excellent air and moisture permeability.

The inventive composition is applicable to any cloths and fabric sheets for which air and moisture permeability is required including not only woven and nonwoven cloths before sawing but also ready-made clothes such as raincoats, anoraks, jumpers, sportswears, working wears and the like. Furthermore, treatment of a protecting gauze used on wounded or burnt skin in surgical treatment with the inventive composition is particularly advantageous because the coating film formed of the composition is quite stable in sterilization by boiling and can exhibit peelability or releasability inherent to silicone materials in gneral.

Following are examples and comparative examples to illustrate the invention in further detail.

EXAMPLE 1

(Compositions No. 1 and No. 2)

A solution type composition was prepared by dissolving 100 parts by weight of a dimethylpolysiloxane terminated at both molecular chain ends with silanolic hydroxy groups and having a relative viscosity of 2.3 which was a ratio of the viscosity of a toluene solution containing 1.0 g of the polymer in 100 ml to the viscosity of pure toluene at 25° C. (referred to as the siloxane I hereinbelow) and 10 parts by weight of a methyl hydrogenpolysiloxane having a viscosity of 35 centistokes at 25° C. (referred to as the siloxane II hereinbelow) in trichloroethylene. The solution contained 20% by weight of the polysiloxanes and had a viscosity of 23,000 centipoise at 20° C. This is called the composition A.

The above prepared composition A was further admixed uniformly with 10% by weight of a commercially available microcapsule type blowing agent with a polyvinylidene chloride resin film as the encapsulating film for isobutane (Micropearl F-30, a product by Matsumoto Yushi Co.). This is called the composition B.

The compositions A and B each in an amount of 100 parts by weight were admixed with 0.5 part by weight of dioctyltin diacetate as a curing catalyst and a taffeta cloth of polyester was coated with either composition by knife coating followed by drying at 100° C. for 1 minute and then heat treatment at 150° C. for 2 minutes to effect curing of the curable silicone composition A or B. The coating amount of the composition was 5 g/m$^2$ as dried. These treated cloths were tested for the water repellency, water-pressure resistance and moisture permeability. The water repellency and water-pressure resistance were measured according to the procedures specified in JIS L 1079 and moisture permeability was measured by the cup method specified in JIS Z 0208 at 40° C. in an atmosphere of 95% relative humidity. Tiny foams were visible on the surface of the cloth treated with the composition B which had a moisture permeability larger by more than three times than the cloth treated with the composition A. Table 1 below summarizes the results of the measurements.

TABLE 1

| No. | Taffeta cloth treated with | Water repellency | Water-pressure resistance, mm aq. | Moisture permeability, $g/m^2 \cdot 24$ hours |
|---|---|---|---|---|
| 1 | Composition A | 100 | 400 | 1500 |
| 2 | Composition B | 90–100 | 350 | 5200 |

EXAMPLE 2

(Compositions No. 3 to No. 5)

Three compositions were prepared without use of any organic solvent each with 85 parts by weight of a dimethylpolysiloxane terminated at both molecular chain ends with silanolic hydroxy groups and having a viscosity of 100,000 centistokes (referred to as the siloxane III hereinbelow), 15 parts by weight of a methyl hydrogenpolysiloxane expressed by the structural formula

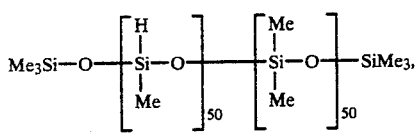

in which Me denotes a methyl group, (referred to as the siloxane IV hereinbelow) and 1 part by weight of an octyl alcohol solution containing 1% by weight of chloroplatinic acid as the catalyst for the crosslinking reaction without or with admixture of 10 parts by weight of a blowing agent which was either the same microcapsule type one as used in Example 1 (referred to as F-30) or 4,4'-hydroxy-bis-benzenesulfonyl hydrazide (Celmic S, a product by Sankyo Kasei Co.). The same taffeta cloth of polyester as used in Example 1 was coated with either one of these compositions by knife coating in a coating amount of 5 $g/m^2$ followed by drying at 100° C. for 1 minute and then heat treatment at 150° C. for 2 minutes to effect curing of the curable silicone composition.

Table 2 below gives the results of the tests undertaken in the same manner as in Example 1 for the evaluation of these treated cloths. As is clear from the table, the water-pressure resistance of the coated cloth was little affected by the admixture of a blowing agent to the composition but the improvement in the moisture permeability was remarkable.

TABLE 2

| No. | Taffeta cloth treated with the composition containing the blowing agent | Water repellency | Water-pressure resistance, mm aq. | Moisture permeability, $g/m^2 \cdot 24$ hours |
|---|---|---|---|---|
| 3 | None | 100 | 800 | 300 |
| 4 | F-30 | 100 | 600 | 560 |
| 5 | Celmic S | 100 | 800 | 500 |

EXAMPLE 3

(Compositions No. 6 to No. 9)

Two solution type compositions (No. 6 and No. 7) were prepared each by dissolving 15 parts by weight of the siloxane I used in Example 1, 5 parts by weight of methyl trimethoxysilane and 0.5 part by weight of dioctyltin diacetate in 80 parts by weight of trichloroethylene without (No. 6) or with (No. 7) admixture of 10 parts by weight of the same microcapsule type blowing agent (F-30) as used in Example 1.

Compositions No. 8 and No. 9 were prepared each by dissolving 45 parts by weight of a dimethylpolysiloxane terminated at both molecular chain ends with silicon-bonded vinyl groups and having a viscosity of 500,000 centistokes at 25° C. (referred to as the siloxane V hereinbelow), 5 parts by weight of the siloxane IV used in Example 2 and 0.1 part by weight of the same octyl alcohol solution of chloroplatinic acid as usd in Example 2 in 50 parts by weight of trichloroethylene without (No. 8) or with (No. 9) admixture of 20 parts by weight of the same microcapsule type blowing agent F-30 as used in Example 1.

Coating treatment of the same taffeta coth of polyester was undertaken with either one of these compositions in a coating amount of 5 $g/m^2$ as dried in the same manner as in the preceding examples. The results of the tests for the evaluation of these treated cloths undertaken also in the same manner as in the preceding examples were as shown in Table 3 below.

TABLE 3

| No. | Blowing agent | Water repellency | Water-pressure resistance, mm aq. | Moisture permeability, $g/m^2 \cdot 24$ hours |
|---|---|---|---|---|
| 6 | No | 100 | 450 | 1200 |
| 7 | Yes | 100 | 400 | 6000 |
| 8 | No | 100 | 750 | 500 |
| 9 | Yes | 100 | 670 | 3100 |

What is claimed is:

1. A foamable silicone-containing composition suitable for the treatment of a fabric material which comprises a curable silicone composition mainly composed of a liquid diorganopolysiloxane with a substantially linear molecular structure having at least two functional groups bonded to the silicon atoms in a molecule as the base polysiloxane, said functional groups being selected from the group consisting of silanolic hydroxy groups, and two alkenyl groups; a liquid organosilicon compound having at least three functional groups bonded to the silicon atoms, said functional groups being selected from the group consisting of hydrogen and hydrolyzable groups; and a condensation catalyst and a blowing agent which is a low-boiling organic liquid encapsulated in a polyvinylidene chloride film in the form of microcapsules, in an amount from 1 to 200 parts by weight per 100 parts by weight of the said curable silicone composition.

2. The foamable silicone-containing composition as claimed in claim 1 wherein the blowing agent is a thermally decomposable organic blowing agent.

3. The foamable silicone-containing composition as claimed in claim 1 wherein the blowing agent is water or an alcohol encapsulated with a silicone resin in the form of microcapsules.

4. The composition of claim 1 wherein the functional groups in the base polysiloxane are selected from the group consisting of hydroxy, vinyl, allyl, epoxy, and mercapto, and the functional groups in the liquid organosilicon compound are selected from the group consisting of hydrogen, vinyl, allyl, alkoxy, acyloxy, oxime, aminoxy, and isopropenoxy.

5. A method for the water-proofing treatment of a fabric material which comprises coating the fabric material with a foamable silicone-containing composition comprising a curable silicone composition mainly composed of a liquid diorganopolysiloxane with a substantially linear molecular structure having at least two functional groups bonded to the silicon atoms in a molecule as the base polysiloxane, said functional groups being selected from the group consisting of silanolic hydroxy groups, and two alkenyl groups; a liquid organosilicon compound having at least three functional groups bonded to the silicon atoms, said functional groups being selected from the group consisting of hydrogen and hydrolyzable groups; and a condensation catalyst and a blowing agent which is a low-boiling organic liquid encapsulated in a polyvinylidene chloride film in the form of microcapsules, in an amount from 1 to 200 parts by weight per 100 parts by weight of the said curable silicone composition and heating the thus coated fabric material to effect curing of the curable silicone composition and simultaneous foaming of the composition.

6. The method of claim 5 wherein the functional groups in the base polysiloxane are selected from the group consisting of hydroxy, vinyl, allyl, epoxy, and mercapto, and the functional groups in the liquid organosilicon compound are selected from the group consisting of hydrogen, vinyl, allyl, alkoxy, acyloxy, oxime, aminoxy, and isopropenoxy.

* * * * *